US008744093B2

(12) United States Patent
Sakamoto et al.

(10) Patent No.: US 8,744,093 B2
(45) Date of Patent: Jun. 3, 2014

(54) ACTIVE VIBRATION/NOISE CONTROL DEVICE

(75) Inventors: Kosuke Sakamoto, Utsunomiya (JP); Toshio Inoue, Tochigi-ken (JP); Akira Takahashi, Tochigi-ken (JP); Yasunori Kobayashi, Utsunomiya (JP)

(73) Assignee: Honda Motor Co., Ltd., Tokyo (JP)

( * ) Notice: Subject to any disclaimer, the term of this patent is extended or adjusted under 35 U.S.C. 154(b) by 663 days.

(21) Appl. No.: 12/995,970

(22) PCT Filed: May 14, 2009

(86) PCT No.: PCT/JP2009/058965

§ 371 (c)(1),
(2), (4) Date: Dec. 2, 2010

(87) PCT Pub. No.: WO2009/147937

PCT Pub. Date: Dec. 10, 2009

(65) Prior Publication Data

US 2011/0123042 A1 May 26, 2011

(30) Foreign Application Priority Data

Jun. 3, 2008 (JP) ..... 2008-145459

(51) Int. Cl.
*A61F 11/06* (2006.01)

(52) U.S. Cl.
USPC ..... 381/71.1; 381/94.1; 381/71.11

(58) Field of Classification Search
CPC ..... G10K 11/1788; G10K 11/178; G10K 2210/1081; G10L 21/0208; G10L 2021/02165
USPC ..... 381/86, 71.1–71.5, 94.1–94.4, 381/71.11–71.14
See application file for complete search history.

(56) References Cited

U.S. PATENT DOCUMENTS

| | | | | |
|---|---|---|---|---|
| 5,416,844 | A * | 5/1995 | Nakaji et al. | 381/71.4 |
| 7,340,065 | B2 * | 3/2008 | Nakamura et al. | 381/71.11 |
| 2008/0240457 | A1 * | 10/2008 | Inoue et al. | 381/71.4 |
| 2009/0074198 | A1 | 3/2009 | Yoshida et al. | |

FOREIGN PATENT DOCUMENTS

| | | | |
|---|---|---|---|
| CN | 101031957 | A | 9/2007 |
| GB | 2 257 601 | A | 1/1993 |
| JP | 07-104767 | A | 4/1995 |
| JP | 2001-51703 | A | 2/2001 |

* cited by examiner

*Primary Examiner* — Lun-See Lao
(74) *Attorney, Agent, or Firm* — Arent Fox LLP

(57) ABSTRACT

An active vibration/noise control device which is provided with a plurality of cancel signal generation parts for generating output signals for respectively cancelling noises generated at a plurality of vibration/noise generation sources. The effect of the suspension of either of first and second cancel signal generation parts on the other is reduced. According to the operating state of the first cancel signal generation part, the simulated transmission properties of the second cancel signal generation part are adjusted. Consequently, without regard to the operating state of the first cancel signal generation part, the noise control performance of the second cancel signal generation part can be maintained.

3 Claims, 8 Drawing Sheets

FIG. 3

$\hat{C}$ (G1=0)

| FREQUENCY | REAL PART | IMAGINARY PART |
|---|---|---|
| 30 | -0.110 | 0.115 |
| 31 | -0.105 | 0.077 |
| 32 | -0.219 | -0.013 |
| 33 | -0.508 | 0.021 |
| 34 | -0.729 | 0.369 |
| 35 | -0.609 | 0.834 |
| 36 | -0.320 | 1.051 |
| 37 | -0.027 | 1.171 |
| 38 | 0.225 | 1.144 |
| 39 | 0.349 | 1.155 |
| 40 | 0.622 | 1.265 |
| 41 | 1.027 | 1.223 |
| 42 | 1.269 | 0.855 |
| 43 | 1.355 | 0.675 |
| 44 | 1.481 | 0.400 |
| 45 | 1.480 | 0.123 |
| · | · | · |
| · | · | · |
| · | · | · |

FIG. 4

$\hat{C}$ (G1=1)

| FREQUENCY | REAL PART | IMAGINARY PART |
|---|---|---|
| 30 | −0.173 | 0.097 |
| 31 | −0.267 | 0.152 |
| 32 | −0.406 | 0.141 |
| 33 | −0.692 | 0.476 |
| 34 | 0.393 | 0.997 |
| 35 | 0.064 | 0.964 |
| 36 | 0.214 | 0.862 |
| 37 | 0.347 | 0.797 |
| 38 | 0.430 | 0.734 |
| 39 | 0.516 | 0.691 |
| 40 | 0.595 | 0.634 |
| 41 | 0.652 | 0.564 |
| 42 | 0.705 | 0.473 |
| 43 | 0.684 | 0.428 |
| 44 | 0.724 | 0.413 |
| 45 | 0.777 | 0.391 |
| · | · | · |
| · | · | · |
| · | · | · |

ACTIVE VIBRATION/NOISE CONTROL DEVICE

CROSS-REFERENCE TO RELATED APPLICATION

This application is a National Stage entry of International Application No. PCT/JP2009/058965, filed May 14, 2009, which claims priority to Japanese Patent Application No. 2008-145459 filed Jun. 3, 2008, the disclosure of the prior application is incorporated in its entirety by reference.

TECHNICAL FIELD

The present invention relates to an active vibration noise control apparatus (active vibration/noise control device) equipped with a plurality of canceling signal producing devices for producing output signals for respectively canceling noises generated by multiple vibration noise producing sources, and relates to an active vibration noise control apparatus, which is suitable for application to, for example, a vehicular active vibration noise control apparatus for reducing vehicle cabin noises in an automotive vehicle.

BACKGROUND ART

Conventionally, a vehicular noise reducing apparatus has been proposed in which noises occurring inside a vehicle cabin from multiple noise events such as, for example, engine noise, road noise, wind noise and the like, are reduced by each of respective canceling signal producing devices (see Japanese Laid-Open Patent Publication No. 07-104767).

With the technique according to Japanese Laid-Open Patent Publication No. 07-104767, a canceling signal producing device for controlling engine noise is operated within a total frequency region from low frequencies to high frequencies. Additionally, at low frequencies, the canceling signal producing device for wind noise is not operated, whereas each of the canceling signal producing devices for engine noise and road noise is operated. On the other hand, at high frequencies, the canceling signal producing device for road noise is not operated, whereas each of the canceling signal producing devices for engine noise and wind noise is operated.

SUMMARY OF INVENTION

However, as described later, in the case that a plurality of canceling signal producing devices are operated, when operation of a particular canceling signal producing device is switched over, it has been understood that an influence is imparted to noise control as a result of the canceling signal producing devices that remain in operation.

Notwithstanding, with the technique according to the aforementioned Japanese Laid-Open Patent Publication No. 07-104767, nothing is disclosed therein concerning influences imparted to canceling signal producing devices that remain in operation when operation of a particular canceling signal producing device is switched over.

In actuality, in the case that operation of a particular canceling signal producing device is stopped, it is understood that operations of the signal producing devices that remain in operation become unstable, and tracking operations thereof become degraded, and in a worst case, there is a fear that noises may even be increased.

The present invention, taking into consideration such types of problems, has the object of providing an active vibration noise control apparatus, which is capable, during operation of a plurality of canceling signal producing devices, of reducing or wiping out the influence on operations of remaining canceling signal producing devices, even when the operational state of a given one of the canceling signal producing devices is changed.

An active vibration noise control apparatus according to the present invention is characterized by a first canceling signal producing device for producing a first reference signal of a frequency relating to a first noise event, and producing a first canceling signal based on first simulated transfer characteristics, which simulate first transfer characteristics in which the first canceling signal output by itself passes through a sound field and is returned to itself as an error signal, and a second canceling signal producing device for producing a second reference signal of a frequency relating to a second noise event, and producing a second canceling signal based on second simulated transfer characteristics, which simulate second transfer characteristics in which the second canceling signal output by itself passes through the sound field and is returned to itself as an error signal, wherein the second canceling signal producing device adjusts the second simulated transfer characteristics corresponding to an operational state of the first canceling signal producing device.

According to the present invention, because a configuration is provided in which the second transfer characteristics of the second canceling signal producing device are adjusted corresponding to the operational state of the first canceling signal producing device, regardless of the operational state of the first canceling signal producing device, any influence imparted to operations of the second canceling signal producing device that remains in operation can be reduced or wiped out.

For example, a configuration can be provided in which the second canceling signal producing device adjusts the second simulated transfer characteristics responsive to operating and stopping of the first canceling signal producing device.

In this case, in the first simulated transfer characteristics, when a gain setting unit is included in which a gain is set for regulating the operational state of the first canceling signal producing device itself, by adjusting the simulated transfer characteristics of the second transfer characteristics of the second canceling signal producing device responsive to the gain of the gain setting unit, with a simple configuration, the noise controlling capability of the active vibration noise control apparatus can be maintained.

When switching between operating and stopping of the first canceling signal producing device is carried out, upon stopping thereof, by switching the gain to zero (gain=0), switching can be preformed easily between operating and stopping of the first canceling signal producing device.

According to the present invention, while multiple canceling signal producing devices are in operation, in the case that the operational state of a particular one of the canceling signal producing devices is changed, since a configuration is provided in which simulated transfer characteristics of transfer characteristics of the remaining canceling signal producing devices are adjusted, regardless of the operational state of the particular canceling signal producing device, any influence imparted to operations of the remaining signal producing devices can be reduced or wiped out.

As a result, regardless of the operational state of a particular canceling signal producing device, the noise controlling capability of the remaining canceling signal producing devices can be maintained.

BRIEF DESCRIPTION OF DRAWINGS

FIG. 3 is an explanatory drawing showing measurement value examples of second simulated transfer characteristics $\hat{C}$ at a time when an operational state of a first canceling signal producing device is OFF (during stoppage thereof);

FIG. 4 is an explanatory drawing showing measurement value examples of the second simulated transfer characteristics $\hat{C}$ at a time when an operational state of the first canceling signal producing device is ON (during operation thereof);

DESCRIPTION OF EMBODIMENTS

Below, an embodiment of the present invention shall be described with reference to the drawings.

Figure 1:
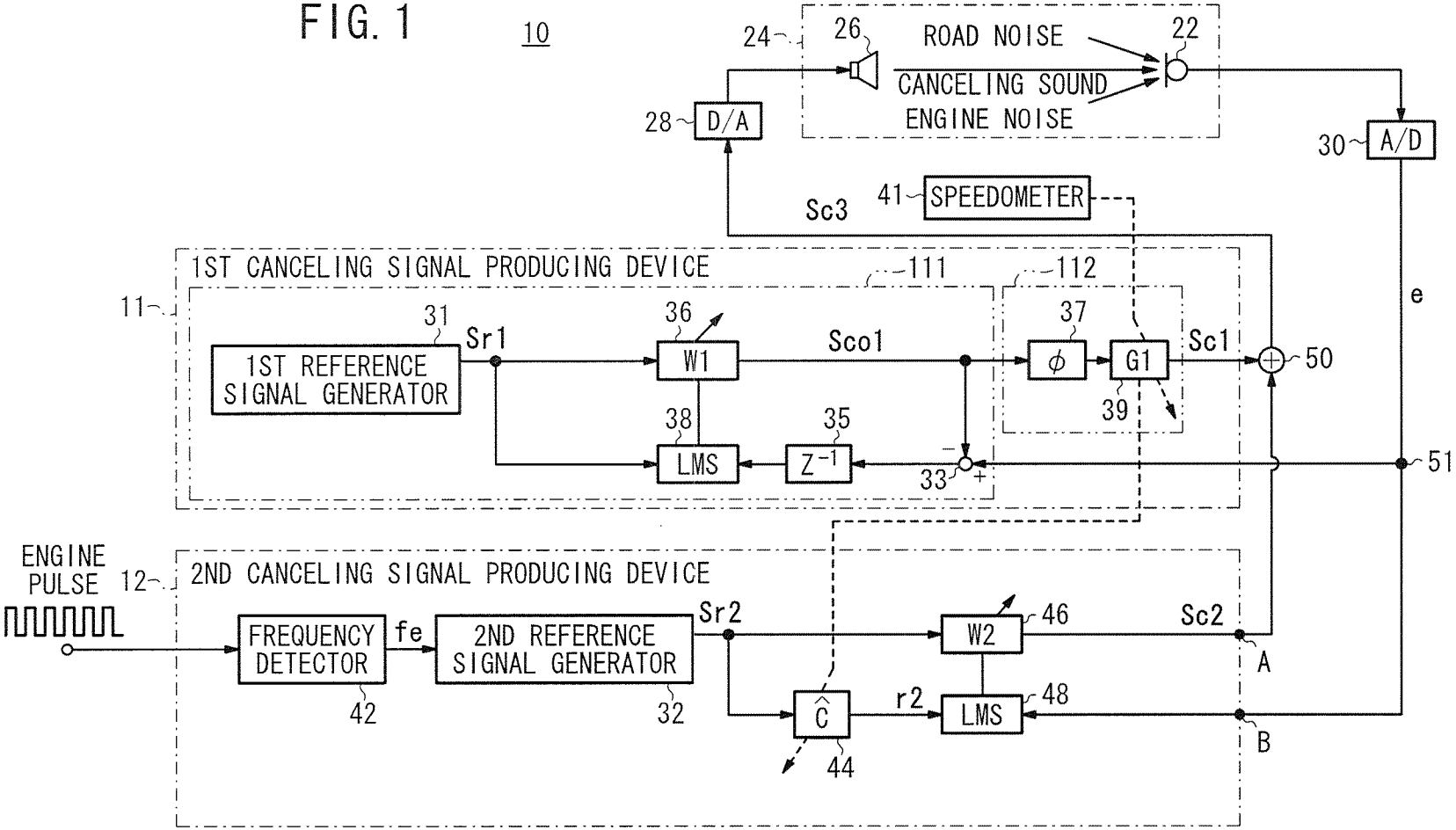
FIG. 1 is a block diagram showing the configuration of an active vibration noise control apparatus according to an embodiment of the present invention.

FIG. 1 is a block diagram showing a basic configuration of a vehicular active vibration noise control apparatus 10 according to an embodiment of the present invention.

The active vibration noise control apparatus 10, which is installed in an automobile, basically comprises a first canceling signal producing device 11 (road noise controller) for producing a first canceling signal Sc1 for generating canceling sounds to cancel road noise, and a second canceling signal producing device 12 (engine noise controller) for producing a second canceling signal Sc2 for generating canceling sounds to cancel engine noise.

The first and second canceling signal producing devices 11, 12 are configured to include a computer, and further operate as function realizing units (function realizing means) that realize various functions, by a CPU executing programs, which are stored in a memory such as a ROM or the like, based on various inputs thereto.

At an evaluation point (evaluation position, listening point), a microphone 22 (error signal detector), which detects, as an error signal e, engine noise (engine booming noise), road noise, and residual noise as a result of interference between canceling sounds thereof, is disposed in a vehicle cabin space 24.

A speaker (canceling sound output device) 26 also is disposed in the vehicle cabin space 24, which outputs, into the vehicle cabin space 24, canceling sounds for canceling the road noise and/or the engine noise, based on a canceling signal Sc3 (Sc3=Sc1+Sc2), which is a composite of the first canceling signal Sc1 and the second canceling signal Sc2, which are added by an adder 50 and supplied from a D/A converter 28.

The error signal e output from the microphone 22 passes through an A/D converter 30 and is converted to a digital error signal e, which then is supplied as an input signal to the first canceling signal producing device 11 and the second canceling signal producing device 12.

The first canceling signal producing device 11 is made up from an adaptive notch filter 111, which functions as a band pass filter, and a first simulated transfer characteristics unit 112.

The adaptive notch filter 111 is equipped with a first reference signal generator 31 for generating a first reference signal Sr1 {a cosine-wave signal $\cos(2\pi fdt)$ and a sine-wave signal $\sin(2\pi fdt)$}, which is synchronized to a road noise frequency fd [Hz] having a degree of, for example, 42 [Hz] determined by vehicle type, a first adaptive filter 36 for generating, from the first reference signal Sr1 and at a subtrahend input terminal of a subtractor 33, an original first canceling signal Sco1 having an amplitude and phase of a component of the road noise frequency fd within the error signal e, and a filter coefficient updater (algorithm computing unit) 38 which is supplied with the first reference signal Sr1 and a signal (e−Sco1) formed by subtracting the original first canceling signal Sco1 from the error signal e, the signal (e−Sco1) being delayed by a one-ample delay device 35, and for updating a filter coefficient W1 of the first adaptive filter 36, which is a single tap adaptive filter, based on an adaptive control algorithm for minimizing the signal (e−Sco1), for example, an LMS (least mean square) algorithm, which is a type of steepest descent method.

The first simulated transfer characteristics unit 112 is constituted from a phase shifter 37 and a gain setting unit 39. In the phase shifter 37, the phase of the original first canceling signal Sco1 is preset to a phase shift quantity, which is opposite in phase to the phase of the road noise at the position of the microphone 22. In the gain setting unit 39, the amplitude of the original first canceling signal Sco1 that has been shifted in phase by the phase shifter 37 is set to a gain G1 that is close to an equivalent gain, with respect to the amplitude of the road noise at the position of the microphone 22. Because the size (amplitude) of the road noise that is heard at the position of the microphone 22 changes corresponding to vehicle speed, a gain G1 is set, which is acquired beforehand corresponding to the speed from a vehicle speedometer 41. When the vehicle is stopped, road noise does not exist, and thus the gain G1 is set to zero (G1=0).

On the other hand, the second canceling signal producing device 12 is a circuit in which a feed—forward type filterd—X LMS algorithm is used.

The second canceling signal producing device 12 comprises a frequency detector (rotational frequency detector) 42 constituted by a frequency counter that detects the rotational frequency fe of an engine crank (rotary body) from an engine rotational signal (engine pulse) supplied from a non-illustrated fuel injection ECU (FIECU), a second reference signal generator 32 for generating a second reference signal Sr2 {a cosine-wave signal $\cos(2\pi fet)$ and a sine-wave signal $\sin(2\pi fet)$} having a frequency equivalent to the rotational frequency fe, a second adaptive filter 46 for generating a second canceling signal Sc2 from the second reference signal Sr2, a reference signal generator (filter) 44, in which there are set second simulated transfer characteristics $\hat{C}$, which simulate the transfer characteristics of the sound of the rotational frequency fe (i.e., each of respective rotational frequencies, since the rotational frequency fe changes responsive to the engine rotation signal) from the output of the second adaptive filter 46, through the adder 50→the D/A converter 28→the speaker 26→the vehicle cabin space 24 (sound field)→the microphone 22→the A/D converter 30, until reaching the input terminal of the second canceling signal producing device 12 (i.e., the input terminal of a later-described filter coefficient updater 48), for thereby convoluting the second reference signal Sr2 and generating a reference signal r2, and the filter coefficient updater (algorithm computing unit) 48 which is supplied with the reference signal r2 and the error signal e, and for updating a filter coefficient W2 of the second adaptive filter 46, which is a single tap adaptive filter, based on an adaptive control algorithm for minimizing the error signal e, for example, an LMS (least mean square) algorithm, which is a type of steepest descent method.

With such a configuration, the phase at the position of the microphone 22 of the second canceling signal Sc2 becomes opposite in phase to the engine noise that is heard at the position of the microphone 22, and the amplitude of the second canceling signal Sc2 at the position of the microphone 22 is made substantially the same amplitude as that of the engine noise heard at the position of the microphone 22, thus enabling engine noises to be silenced at the position of the microphone 22.

Further, the first canceling signal Sc1 and the second canceling signal Sc2 are added by the adder 50, and after passing through the D/A converter 28 and the speaker 26, are heard as canceling sounds at the microphone 22.

The gain G1 of the gain setting unit 39 is made variable responsive to the operational state of the first canceling signal producing device 11. Reasons (problems) shall now be explained, with reference to FIG. 2, as to why it is necessary for the second simulated transfer characteristics $\hat{C}$ of the reference signal generator 44 of the second canceling signal producing device 12 to be adjusted at times when the gain G1 of the gain setting unit 39 is varied.

Figure 2:
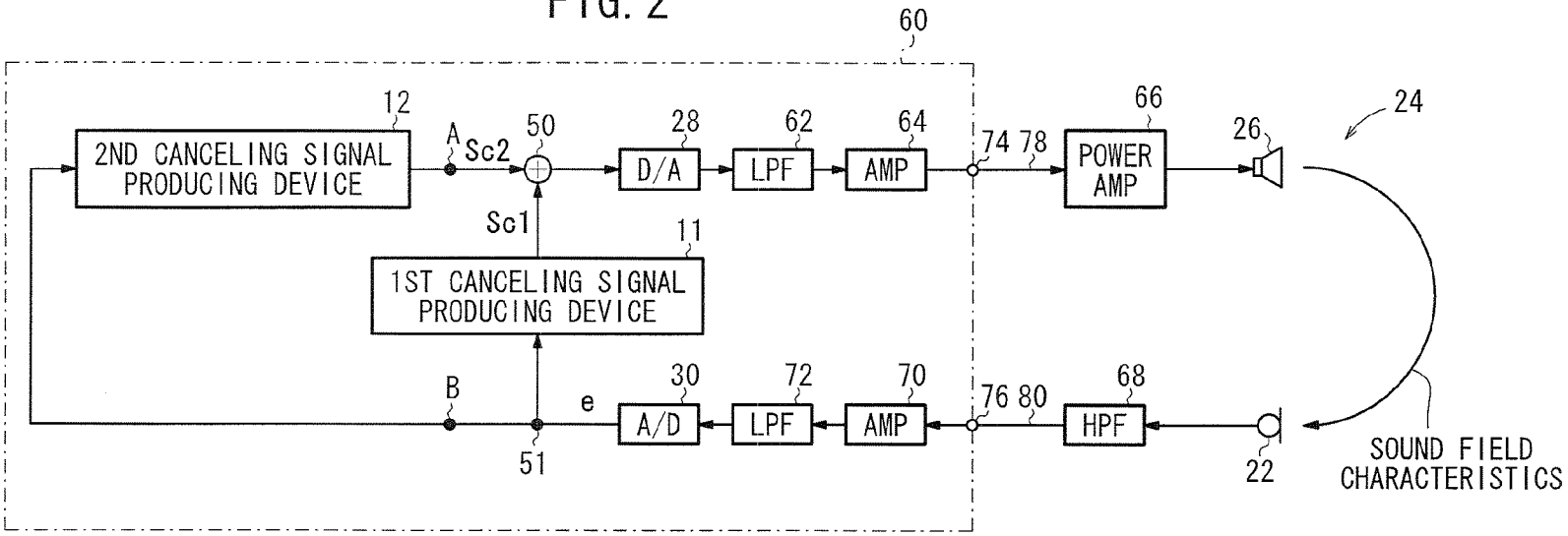
FIG. 2 is an explanatory drawing of constituent elements of transfer characteristics (a transfer function) from an output port to an input port of a second canceling signal producing device.

As shown in FIG. 2, in which a portion of the active vibration noise control apparatus 10 shown in FIG. 1 is depicted in more detail, the first and second canceling signal producing devices 11, 12 are mounted on an electronic circuit board 60.

FIG. 2 is an explanatory drawing for explaining constituent elements of transfer characteristics (a transfer function) from a port (output port) A (see FIG. 1), which is an output point of the second canceling signal producing device 12, to a port (input port) B, which is an input point of the second canceling signal producing device 12.

The transfer characteristics are frequency transfer characteristics of a path over which the second canceling signal Sc2, which is a signal output from the output port A, is returned as an error signal e to the input port B.

More specifically, it is understood that such transfer characteristics are of a parallel path, comprising a path from the output port A, passing through the adder 50, the D/A converter 28, a low pass filter (LPF) 62, an amplifier (AMP) 64, a terminal 74, wirings 78, a power AMP 66, the speaker 26, the vehicle cabin space 24 that forms the sound field characteristics, the microphone 22, a high pass filter (HPF) 68, wirings 80, a terminal 76, an amplifier 70, an LPF 72, and the A/D converter 30, until reaching the input port B that generates the error signal e, and a path from a branch point 51 (see FIG. 1) via the first canceling signal producing device 11 until reaching the adder 50.

Stated otherwise, as understood from FIG. 2, in the path from the output port A of the second canceling signal producing device 12 to the input port B, because the first canceling signal producing device 11 is connected in parallel therewith, as a result, the transfer characteristics from the output port A of the second canceling signal producing device 12 to the input port B thereof are changed corresponding to operational states {(e.g., operating (ON) and stoppage (OFF)) of the first canceling signal producing device 11.

More specifically, in the case that both the first canceling signal producing device 11 and the second canceling signal producing device 12 are operated, e.g., when operations of only the first canceling signal producing device 11 for reducing road noise are terminated, it is understood that the transfer characteristics (amplitude and phase transfer characteristics with respect to frequency) of the noise control path of the second canceling signal producing device 12 for decreasing engine noise tend to change, and thus there is a problem, in that cases occur in which vibration noise control (in this case, control to cancel out engine noise) by the second canceling signal producing device 12, which remains in operation, becomes insufficient or unstable.

In order to solve this problem, according to the present embodiment, a configuration is provided such that, corresponding to the operational state of the first canceling signal producing device 11, the second canceling signal producing device 12 adjusts the second simulated transfer characteristics $\hat{C}$ that make up the reference signal generator 44 of the second canceling signal producing device 12.

The transfer characteristics (amplitude and phase transfer characteristics with respect to frequency) of the path from port A to port B of FIG. 2, which correspond to the second simulated transfer characteristics $\hat{C}$, are measured beforehand corresponding to the operational state of the first canceling signal producing device 11.

Further, although the transfer characteristics from port A to port B are obtained by plotting the change in phase and amplitude at port B with respect to a frequency change of a signal generator of constant amplitude at port A in a state in which the second canceling signal producing device 12 is removed, in order to carry out digital calculations, such measurements are made as vectors, which are made up from real and imaginary parts of each of respective frequencies.

FIG. 3 shows measurement value examples of second simulated transfer characteristics $\hat{C}$ (G1=0) at a time when the operational state of the first canceling signal producing device 11 is in a stoppage state, and more specifically, when the speed measured by the vehicle speedometer 41 is zero and the gain G1 of the gain setting unit 39 is zero (G1=0).

FIG. 4 is an explanatory drawing showing measurement value examples of second simulated transfer characteristics $\hat{C}$ (G1>0) at a time when the operational state of the first canceling signal producing device 11 is ON (i.e., during operation thereof), and more specifically, when the vehicle speed measured by the vehicle speedometer 41 is a predetermined speed during running of the vehicle and the gain G1 of the gain setting unit 39 is greater than zero (G1>0). In the following explanations, for ease of understanding, the gain G1 during operation of the first canceling signal producing device 11 at the predetermined vehicle speed is normalized at G1=1.

In the second simulated transfer characteristics $\hat{C}$ (G1=1) during operation of the first canceling signal producing device 11 (G1=1) shown in FIG. 4, for example, at a road noise frequency of fd=42 [Hz], the real part=0.705 and the imaginary part=0.473, whereas in the second simulated transfer characteristics $\hat{C}$ (G1=1) during stoppage of the first canceling signal producing device 11 (G1=0) shown in FIG. 3, it can be understood that a change occurs in which the real part=1.269 and the imaginary part=0.855.

Figure 5:
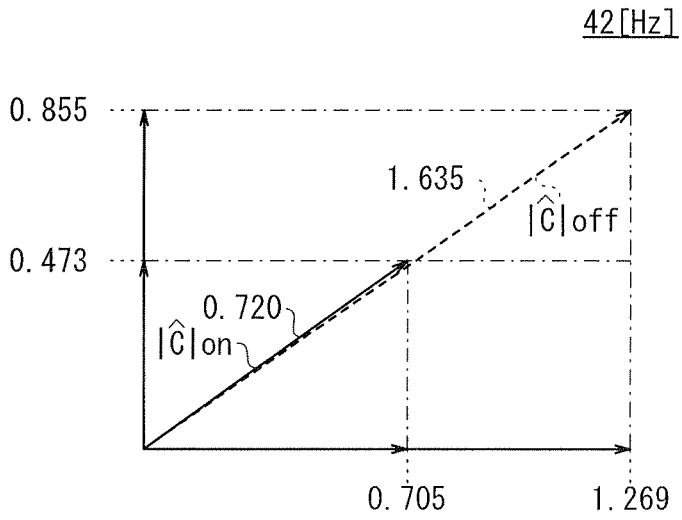
FIG. 5 is an explanatory diagram of vectors at times when an operational state of the first canceling signal producing device is OFF and ON respectively.

FIG. 5 shows vectors of the aforementioned cases. The size of the vectors is such that when G1=1, $|\hat{C}|$ on=0.720, and when G1=0, $|\hat{C}|$off=1.635.

Figure 6:
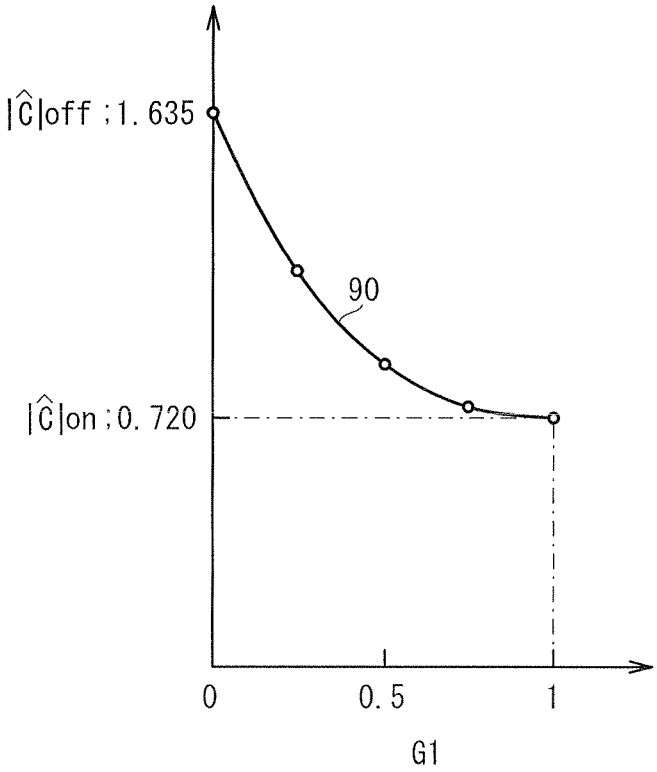
FIG. 6 is an explanatory diagram showing change characteristics in the size of a vector corresponding to an operational state of the first canceling signal producing device.

FIG. 6 shows change characteristics 90 in the size of the vector |Ĉ| corresponding to the operational state (G1=0 to 1) of the first canceling signal producing device 11 at 42 [Hz].

Figure 7:
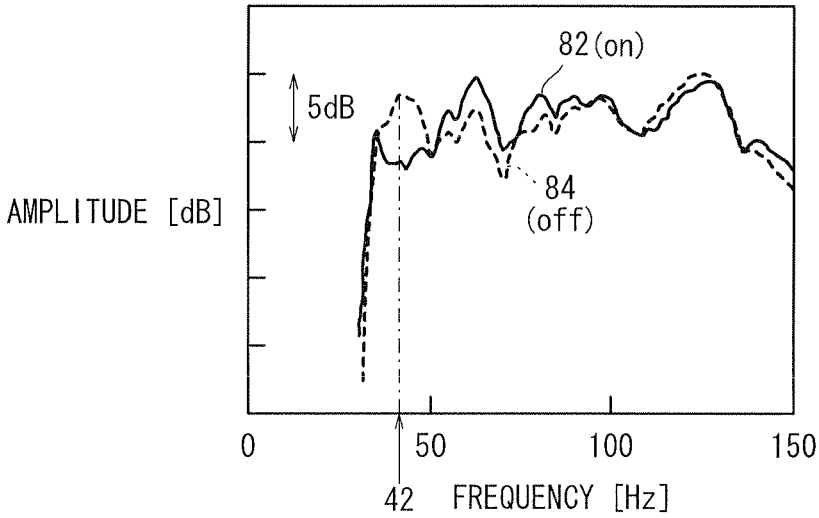
FIG. 7 is an explanatory diagram showing amplitude and frequency characteristics from an output port to an input port during operation and stoppage of the first canceling signal producing device.

FIG. 7 shows, by solid and dashed lines respectively, amplitude and frequency characteristics 82, 84 ([dB]-[Hz]) from the output port A to the input port B during operation (on, G1=1) and stoppage (off, G1=0) of the first canceling signal producing device 11.

Figure 8:
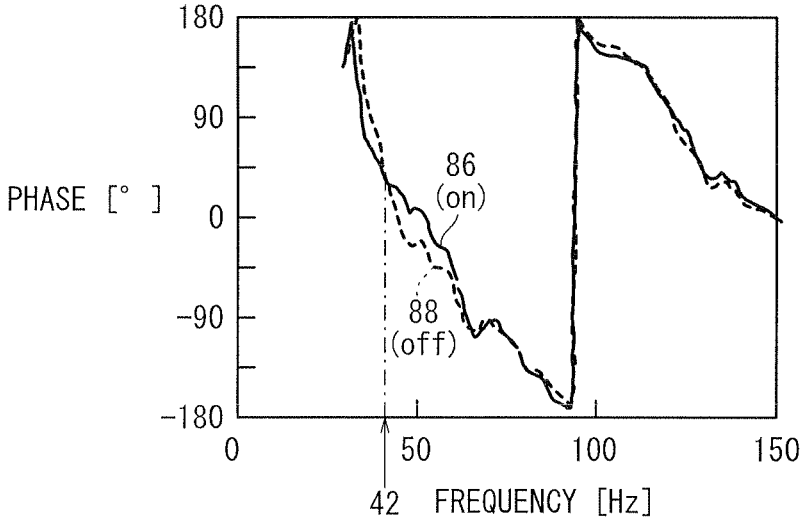
FIG. 8 is an explanatory diagram showing phase and frequency characteristics from an output port to an input port during operation and stoppage of the first canceling signal producing device.

FIG. 8 shows, by solid and dashed lines respectively, phase and frequency characteristics 86, 88 ([°]-[Hz]) from the output port A to the input port B during operation (on, G1=1) and stoppage (off, G1=0) of the first canceling signal producing device 11.

The characteristics 82, 84, 86, 88 of FIGS. 7 and 8 correspond to the second simulated transfer characteristics of FIG. 3 and FIG. 4, i.e., Ĉ(G1=0) and Ĉ(G1=1).

As described above, the active vibration noise control apparatus 10 according to the above-described embodiment is equipped with a first canceling signal producing device 11 for generating a first reference signal Sr1 of a frequency related to road noise as a first noise event, and for producing a first canceling signal Sc1 based on first simulated transfer characteristics (first simulated transfer characteristics unit 112), in which first transfer characteristics of the first canceling signal Sc1 output by itself passing through a sound field including the vehicle cabin space 24 and being returned to itself as an error signal e {i.e., transfer characteristics of a path mainly from the adder 50, through the D/A converter 28, the vehicle cabin space 24 (a path including the speaker 26 and the microphone 22), and the A/D converter 30, and until reaching the branch point 51} are simulated, and a second canceling signal producing device 12 for generating a second reference signal Sr2 of a frequency fe related to engine noise as a second noise event, and for producing a second canceling signal Sc2 based on second simulated transfer characteristics Ĉ, in which second transfer characteristics of the second canceling signal Sc2 output by itself passing through the sound field and being returned to itself as an error signal e {i.e., transfer characteristics of a path mainly from the adder 50, through the D/A converter 28, the vehicle cabin space 24 (a path including the speaker 26 and the microphone 22), and the A/D converter 30, and until reaching the branch point 51} are simulated. Because the second canceling signal producing device 12 is configured to adjust the second simulated transfer characteristics Ĉ corresponding to the operational state of the first canceling signal producing device 11, regardless of the operational state of the first canceling signal producing device 11, any influence imparted to operations of the second canceling signal producing device 12 that remains in operation can be reduced or wiped out.

For example, a structure can be provided in which the second simulated transfer characteristics Ĉ are adjusted corresponding to operation and stoppage of the first canceling signal producing device 11.

In this case, as shown in FIG. 1, when in the first simulated transfer characteristics (the first simulated transfer characteristics unit 112) there is included the gain setting unit 39, in which the gain G1 is set for regulating the operational state of the first canceling signal producing device 11 itself, by adjusting, by the second canceling signal producing device 12, the second simulated transfer characteristics Ĉ thereof corresponding to the gain G1 of the gain setting unit 39, with a simple configuration, the noise controlling capability of the active vibration noise control apparatus 10 including the second canceling signal producing device 12 in operation can be maintained.

Upon switching the first canceling signal producing device 11 between operation and non-operation thereof, i.e., when switching to a non-operational state, by switching the gain G11 to zero (G1=0), switching between operational and non-operational states of the first canceling signal producing device 11 can easily be performed.

Of course, when the operational state of the first canceling signal producing device 11 is to be placed in an OFF state, in place of switching the gain G1 to zero (G1=0), a configuration may be provided in which supply of power to the first canceling signal producing device 11 is interrupted.

The present invention is not limited to the above-described embodiments. It is a matter of course that various other structures could be adopted based on the disclosed content of the present specification, such as applying the feature of setting the gain to zero during non-operational states also when a canceling signal producing device for wind noise that flows over the vehicle surface is provided in place of the first canceling signal producing device 11, for example.

The invention claimed is:

1. An active vibration noise control apparatus comprising:

a first canceling signal producing device for producing a first reference signal of a frequency relating to a first noise event, and producing a first canceling signal based on first simulated transfer characteristics, which simulate first transfer characteristics in which the first canceling signal output by itself passes through a sound field and is returned to itself as an error signal, wherein the first canceling signal producing device includes a first reference signal generator, a first adaptive filter, a filter coefficient updater, a phase shifter and a gain setting unit; and a second canceling signal producing device for producing a second reference signal of a frequency relating to a second noise event, and producing a second canceling signal based on second simulated transfer characteristics, which simulate second transfer characteristics in which the second canceling signal output by itself passes through the sound field and is returned to itself as an error signal, wherein the second canceling signal producing device includes a frequency detector, a second reference signal generator, a second adaptive filter, a reference signal generator and a filter coefficient updater, wherein the second canceling signal producing device adjusts the second simulated transfer characteristics corresponding to an operational state of the first canceling signal producing device.

2. The active vibration noise control apparatus according to claim 1, wherein the second canceling signal producing device adjusts the second simulated transfer characteristics responsive to operating and stopping of the first canceling signal producing device.

3. The active vibration noise control apparatus according to claim 1, wherein the gain setting unit sets a gain for regulating the operational state, and the second canceling signal producing device adjusts the second simulated transfer characteristics responsive to the gain of the gain setting unit.

* * * * *